United States Patent [19]

Bueno

[11] Patent Number: 4,523,486

[45] Date of Patent: Jun. 18, 1985

[54] VIBRATORY DEVICE

[75] Inventor: Alfredo Bueno, Sao Paulo, Brazil

[73] Assignee: Dynapac Maskin AB, Solna, Sweden

[21] Appl. No.: 464,465

[22] Filed: Feb. 7, 1983

[30] Foreign Application Priority Data

Feb. 15, 1982 [SE] Sweden ..... 8200893

[51] Int. Cl.[3] ..... B06B 1/16; E01C 19/28

[52] U.S. Cl. ..... 74/87; 366/128; 404/117

[58] Field of Search ..... 74/87; 209/366.5; 366/128; 404/117

[56] References Cited

U.S. PATENT DOCUMENTS

| | | | |
|---|---|---|---|
| 2,457,413 | 12/1948 | Stokes et al. | 74/87 |
| 2,660,067 | 11/1953 | Glover | 74/87 |
| 2,730,902 | 1/1956 | Karlstrom | 366/128 X |
| 3,179,975 | 4/1965 | Nacci et al. | 366/128 X |
| 3,616,730 | 11/1971 | Boone et al. | 74/87 X |
| 3,966,344 | 6/1976 | Haber et al. | 404/117 |
| 4,221,499 | 9/1980 | Breitholz et al. | 404/117 |

FOREIGN PATENT DOCUMENTS

| | | | |
|---|---|---|---|
| 763361 | 4/1934 | France | 404/117 |
| 1200390 | 12/1959 | France | 404/117 |
| 620286 | 8/1978 | U.S.S.R. . | |
| 691213 | 10/1978 | U.S.S.R. . | |
| 845870 | 7/1981 | U.S.S.R. | 74/87 |

*Primary Examiner*—Allan D. Herrmann

*Attorney, Agent, or Firm*—Brumbaugh, Graves, Donohue & Raymond

[57] ABSTRACT

A vibratory apparatus in which the amplitude of vibration is continuously adjustable, includes a tubular rotatable shaft journalled in the member to be vibrated, and at least one elongated and flexible eccentric mass element disposed in the tubular shaft. The eccentric mass element is guided along guide surfaces, arranged so that part of the eccentric mass element is urged by centrifugal force away from the axis of the tubular shaft when the shaft is rotating. An adjustment means is coupled to the eccentric element to control the position of the element along the slide surfaces, to thereby vary the vibration amplitude of the vibrating tubular shaft.

13 Claims, 2 Drawing Figures

VIBRATORY DEVICE

BACKGROUND OF THE INVENTION

The present invention is a vibratory device of the imbalance type for generating vibrations with an amplitude which is selectively variable while the shaft is rotating.

A typical application of such device is for soil and asphalt compaction machines. In the compaction of soil, asphalt, and similar materials by means of vibratory rollers, it is often necessary to adapt the amplitude of the vibration to the nature of the bedding in order to achieve the desired compaction effect. As a general rule, the greater the amplitude of vibration, the higher the compaction effect. However, when vibrations of relatively large amplitude are used, as the compaction process approaches its final stages, it often happens that the machine, acting on the substantially compacted surface, begins to run irregularly, producing high stresses in all of its parts. By reducing the vibration amplitude in the final compaction stages, the irregular motion of the machine can be stopped. By selecting a desired initial vibration amplitude, and by adjusting the vibration amplitude during the compaction process, it is possible to obtain the maximum compaction effect for the type of compaction machine in use, suited for the particular type of bedding. At the same time, over-compaction can be avoided or at least reduced.

A pre-requisite for this operation is the use of a vibration element with a continuously adjustable amplitude. Previously, known vibratory devices of this general type effect amplitude adjustment by using one or more mass elements arranged on a rotating shaft, and capable of being pivoted in relation to the shaft and to one another. Adjusting devices interact with the mass elements for the purpose of achieving a continuously variable vibration amplitude while the shaft is rotating.

Another known method for generating vibrations with a continuously variable amplitude is to use a liquid contained in a container, applied to the rotating shaft. The liquid volume is increased and decreased during rotation of the shaft, forming an imbalance element and thereby varying the amplitude of vibration movement generated during rotation.

These systems, however, are often complicated and require complex adjustment mechanisms. In certain hydraulic systems the volume of oil under pressure is also in rotation, while necessitates a rotary seal with the danger of leakage and troublesome heat generation in the oil as a result.

SUMMARY OF THE INVENTION

In a preferred embodiment of the present invention, a vibratory device includes a rotating, tubular shaft. One or more eccentric mass elements are arranged in the shaft, and displaceable toward and away from the axis of rotation of the shaft, in a controlled fashion, for increasing or decreasing the amplitude of vibration of the shaft. The device is relatively simple in construction as compared with known devices, and possesses inherent reliability in operation.

More particularly, a vibratory device which has a continuously adjustable vibration amplitude includes a tubular rotatable shaft journalled in a member to be vibrated, for example a drum. At least one elongated and flexible eccentric mass element is disposed in the tubular shaft, and supported by a guide in the tubular shaft. The guide is oriented to cause at least a portion of the eccentric mass element to be urged by centrifugal force away from the axis of the tubular shaft when the shaft is rotating. An adjustment element, preferably a tension-bearing cable, is coupled to the eccentric mass element to control the position of the eccentric element along the guide, and thereby vary the vibration amplitude of the vibrating tubular shaft.

In a preferred embodiment, the guide includes slide surfaces for the eccentric mass element, and a pulley, located in the tubular shaft, with the pulley shaft positioned perpendicularly to the axis of the tubular shaft. The flexible eccentric mass element extends along a first slide surface, generally co-axial with the shaft axis, about the pulley, and along a second slide surface spaced from the shaft axis. The portion of the mass element about the pulley extends in a direction away from the shaft axis. Accordingly, when the shaft rotates this portion of the element is urged, by centrifugal force, outwardly. The second slide surface may also be oriented at an angle to the shaft axis, so that the portion of the mass element lying along the second slide surface is also urged outwardly.

Preferably, two elongated and flexible eccentric mass elements are mounted in the tubular shaft, the eccentric elements being joined together at one end, and the tension-bearing cable is coupled to the joined end of the eccentric elements. In such a construction, portions of the two eccentric mass elements are arranged to extend along slide surfaces oriented oppositely, for balancing the vibration amplitude along the length of the tubular rotatable shaft.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
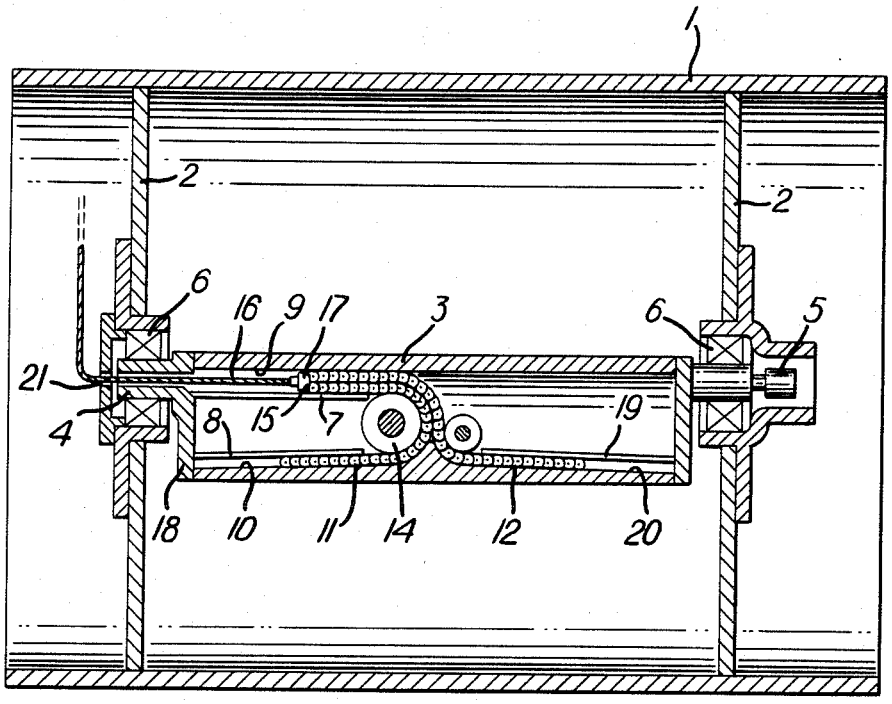
FIG. 1 is a longitudinal section through a vibratory roller having a vibratory device in accordance with the invention.

Referring to FIG. 1, a vibratory roller 1 has a pair of end walls 2 in which an eccentric shaft 3 is rotatably journalled. In the illustrative example shown, eccentric shaft 3 is tubular with bearing journals 4 and 5 applied to either end of the tube. These bearing journals carry the tube and are journalled in the roller end walls in bearings 6. The journal 5 includes a drive element, which as shown extends from the bearing 6 and can be coupled to a drive source (not shown) for rotating the shaft 3. When the shaft 3 is rotated, it imparts a vibration-generating rotational movement to the roller 1.

Two radially separated slide plates 7 and 8 are arranged inside the tubular shaft 3 and essentially parallel to the inner wall of the tube. Together, the slide plates and sections 9 and 10 of the inner wall of shaft 3, opposite the slide plates, form guide surfaces for two elongated, flexible eccentric mass elements 11 and 12, which can slide along these surfaces.

Figure 2:
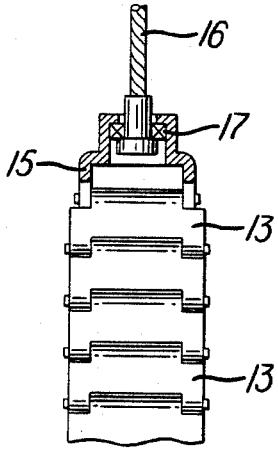
FIG. 2 is a detailed illustration of a portion of an eccentric mass element and adjusting cable in accordance with the invention.

An example of an eccentric mass element in accordance with the invention is shown on a larger scale in FIG. 2. It is constructed in essentially the same manner as a generally known bicycle chain, being composed of a number of pivot-linked mass elements 13, which together constitute the total mass of the eccentric mass element.

The part of the chain-like mass element 11 that is guided by the aforementioned guide surfaces 7 and 9 is axially oriented in relation to the shaft 3 and coincides essentially with the axis of rotation of the tubular shaft 3. The element 11 extends about a guide pulley 14 in the middle of the tube and down between slide plate 8 and inner wall section 10 of the tube 3.

As the shaft 3 rotates, the portion of the mass element 11 along slide surfaces 7, 9 produce little if any eccentric force. The portions of mass element 11 which extend about pulley 14 and along slide surfaces 8, 10, in contrast, are spaced from the rotational axis of the shaft 3, and thereby impart eccentric force to the shaft 3 and roller 1.

A sleeve-like element 15 has a yoke portion which is pivotably attached to the terminal mass element 13. A control cable 16 is rotatably mounted in the end of the sleeve 15, in bearing 17. The cable 16 extends along the axis of the shaft 3, passing through a hole in the bearing journal 4 and up to a control handle in the vehicle's operator station (not shown).

The mass elements 13 in the chain-like eccentric mass element 11 are so distributed in relation to the axis of rotation of the tube 3 that the mass elements 13 that lie in contact with the pulley 14 are acted upon during rotation of the shaft 3 by centrifugal forces that strive to push the chain 11 in between the guide surfaces 8 and 10.

The force that causes this sliding of the chain 11 can be increased by orienting the guide surfaces 8 and 10, in relation to the axis of rotation of the tube 3, in the manner shown so that the mass elements 13 are continuously moved farther away from the axis of rotation of the tube 3 as they are pushed in between the aforementioned surfaces, or in other words so that they form an angle with the axis of rotation of the tube 3.

The centrifugal force acting on the chain 11 during rotation can be counteracted by applying a tensile force to tension cable 16. At the lowest amplitude, the chain 11 with its cable sleeve 15 is flush up against end wall 18. In the opposite position, i.e. at maximum amplitude, the cable is let out such that the sleeve 15 is in contact with the pulley 14.

In order to distribute the vibratory force generated during rotation along the entire length of the tube and thereby distribute the load equally on the two bearing journals 4 and 5, an additional eccentric mass element 12 is disposed inside the tube 3. It is suitably arranged so that the part of the chain 12 that is connected with the tension cable 16 is integrated with the corresponding part of element 11, whereby the cable sleeve 15 is common to the two elements 11, 12.

After the pulley 14, chain 12 runs in the opposite direction of chain 11, and its part most distant from the axis of rotation runs in between a slide plate 19, essentially parallel to the axis of rotation of the tube, and section 20 of the inner wall of the tube 3 opposite this slide plate. These guide surfaces can also be oriented in the same manner as guide surfaces 8 and 10, i.e., to extend at an angle relative to the axis of the tube 3, away from the axis of rotation, in order to increase the tensile force on the chain under the influence of the centrifugal forces acting upon it. If desired, to facilitate the change in direction of the element 12 as it bends toward the slide surface 19, 20, a second pulley, opposite to pulley 14, may be provided, so that the element 12 is wrapped about the second pulley, as shown in FIG. 1.

In order to permit adjustment of the desired vibration amplitude, i.e. adjustment of the position of the eccentric elements of the chains 11 and 12, the tension cable 16 is run through a hole 21 in the bearing journal 4 and up to a position accessible to the operator (not shown). When the cable 16 is pulled, the eccentric elements 11 and 12 are pulled in between the slide surfaces 7 and 9, resulting in a reduction of vibration amplitude. If the tension in the cable 16 is released, the elements or the chains 11 and 12 tend to be pulled in between the slide surfaces 8 and 10 on the one hand and 19 and 20 on the other, due to the effect of centrifugal force.

The invention has permitted the realization of a vibratory element whereby continuous adjustment of the vibration amplitude is possible during operation and by means of simple and reliable adjustment devices. It is also possible for the operator to select accurately a desired vibration amplitude while the roller is operating, since such amplitude is a function of the displacement of the cable 21, which can be measured externally.

Moreover, in the preferred embodiment employing two mass elements 11 and 12, the eccentric force is distributed uniformly along the length of shaft 3, so as to load equally the two journals 4, 5. While the portions of the elements 11 and 12 between slide surfaces 7 and 9 are generally to one side of center, they are co-axial with the shaft axis and thus generate little eccentric force. The portions of the cables 11, 12 which co-extend about pulley 14, are disposed approximately mid-way between journals 4 and 5, and thus will impart a balanced load on journals 4 and 5. Finally, the outer portions of the mass elements 11 and 12, which lie along slide surfaces 8, 10 and 19, 20, respectively, extend in opposite directions to counter-balance one another and thereby load the journals 4, 5 equally.

The foregoing represents a description of a preferred embodiment of the invention. Variations and modifications of the embodiment shown will be apparent to persons skilled in the art, without departing from the inventive concepts shown therein. All such modifications and variations are intended to be within the scope of the invention, as defined in the following claims.

I claim:

1. Apparatus for continuous adjustability of the vibration amplitude of a vibration generator, comprising a tubular shaft rotatably supportable about an axis by a member to be vibrated; at least one eccentric mass element; guide means supported by the tubular shaft and having surfaces for supporting the eccentric mass element for movement therealong, the surfaces being substantially parallel to said axis and being oriented to cause at least a portion of the eccentric mass element to be urged by centrifugal force away from the axis of the tubular shaft along the surfaces when the shaft is rotating, and adjustment means coupled for moving the eccentric element along the surfaces to control the position of the eccentric element, wherein movement of said eccentric mass element along said surfaces changes the vibration amplitude of the rotating tubular shaft.

2. Apparatus as defined in claim 1, wherein said eccentric mass element comprises an elongated, flexible element disposed in the tubular shaft, and wherein said guide means include slide surfaces in the tubular shaft for the eccentric mass element.

3. Apparatus as defined in claim 2, wherein said guide means includes a pulley located in the tubular shaft and having a pulley shaft positioned perpendicularly to the axis of the tubular shaft, and the flexible eccentric mass element is positioned to roll on the pulley during sliding movement.

4. Apparatus as defined in claim 2, wherein said adjustment means comprises an elongated, flexible tension-bearing element, and means for rotatably coupling said eccentric mass element and said tension-bearing element.

5. Apparatus as defined in claim 3, wherein said guide means defines a first slide surface, disposed substantially along the axis of the tubular shaft, and a second slide surface spaced from said axis, and wherein said eccentric mass element is arranged to extend along said first slide surface, about said pulley, and along said second slide surface.

6. Apparatus as defined in claim 5, wherein said second slide surface is disposed at an angle relative to the axis of the tubular shaft, to extend away from said axis.

7. Apparatus as defined in claim 6, wherein said eccentric mass element comprises a plurality of coupled mass elements.

8. Apparatus as defined in claim 3, comprising a second elongated and flexible eccentric mass element disposed in the tubular shaft, wherein the eccentric mass elements are joined together at one end and the adjustment means are coupled to said end of the eccentric mass elements.

9. Apparatus as defined in claim 8, wherein said guide means define a first slide surface, disposed substantially along the axis of the tubular shaft, and second and third slide surfaces spaced from said axis, said second and third surfaces being oppositely oriented along said axis, wherein said eccentric mass elements are arranged to extend along said first slide surface, wherein said mass element extends from said first slide surface, about said pulley, and along said second slide surface, and wherein said second mass element extends from said first slide surface to said third slide surface.

10. Apparatus as defined in claim 9, wherein said second and third slide surfaces are disposed at an angle relative to the axis of the tubular shaft, each extending away from said axis.

11. Apparatus as defined in claim 10, wherein said adjustment means comprises an elongate flexible tension-bearing element and means for rotatably coupling said tension-bearing element and said eccentric mass elements.

12. Apparatus as defined in claim 11, wherein said tubular shaft has journals at opposite ends thereof to be supported in a member to be vibrated, wherein at least one journal of said shaft has an opening therethrough, and wherein said flexible tension-bearing element extends from the interior of said shaft through the opening in the one said journal.

13. Apparatus as defined in claim 12, wherein said pulley is substantially centrally located relative to said journals.

* * * * *